United States Patent [19]

Keith et al.

[11] Patent Number: 4,605,438

[45] Date of Patent: Aug. 12, 1986

[54] APPARATUS AND METHOD FOR FORMING A WEAR-RESISTANT METAL COMPOSITION

[75] Inventors: Earl K. Keith, Clute; William E. Mercer, II, Brazoria; Clarence R. Dick, Lake Jackson, all of Tex.

[73] Assignee: The Dow Chemical Company, Midland, Mich.

[21] Appl. No.: 749,855

[22] Filed: Jun. 28, 1985

[51] Int. Cl.[4] ..... C22B 21/00; C22B 26/22; F27B 13/00

[52] U.S. Cl. ..... 75/67 A; 75/62; 75/68 R; 75/93 R; 266/216; 420/402; 420/528; 420/590

[58] Field of Search ..... 266/216; 420/402, 590, 420/528; 75/67 A, 67 R, 68 R, 62, 93 R

[56] References Cited

U.S. PATENT DOCUMENTS

| | | | |
|---|---|---|---|
| 2,890,039 | 6/1959 | Schmidt | 266/216 |
| 3,272,619 | 9/1966 | Sweeney et al. | 420/590 |
| 3,728,108 | 4/1973 | Sifferlen et al. | 420/528 |
| 3,858,640 | 1/1975 | Sifferlen | 420/528 |
| 4,298,377 | 11/1981 | Szekely | 75/93 R |

*Primary Examiner*—Melvyn J. Andrews
*Attorney, Agent, or Firm*—V. Dean Clausen

[57] ABSTRACT

The invention described herein is an apparatus and method for forming a wear-resistant metal composition. As a specific example, aluminum oxide powder is added to a magnesium alloy to provide a wear-resistant magnesium composition. The magnesium alloy, as the base metal, is placed in a crucible and melted with a burner positioned external to the crucible. A pump having a suction side and a discharge side is mounted on the crucible, with the pump head being suspended below the surface of the molten magnesium. The pump includes a feed tube connected to the suction side, and this tube has a suction opening therein which lies partly above and partly below the surface of the molten metal. The aluminum oxide is fed into the feed tube, and the suction action of the pump causes a vortex at the molten metal surface. The vortex pulls the molten magnesium through the suction opening where it mixes with the aluminum oxide powder. The resulting blend of magnesium and aluminum oxide gives a good, wear-resistant magnesium product.

10 Claims, 2 Drawing Figures

APPARATUS AND METHOD FOR FORMING A WEAR-RESISTANT METAL COMPOSITION

BACKGROUND OF THE INVENTION

The invention relates to an apparatus and method for forming a wear-resistant metal composition. In particular, the invention relates to forming of a wear-resistant magnesium or magnesium alloy.

It is common practice to mix solid additives, such as metal oxides, with magnesium or other materials to improve the wear resistance of the metal. For example, aluminum oxide, magnesium oxide, or mixtures thereof, are blended with a partially liquid magnesium or magnesium alloy matrix to give a magnesium composite in which the solidified product has good wear resistance. Improving the wear resistance of the magnesium product makes it useful for fabricating various articles, such as rollers, pulleys, cylinder liners, pistons, and other devices. Since the solid oxide materials are highly insoluble in the partially liquid metal matrix, it is difficult to achieve good distribution of the solid additives in the base metal. Recent methods have been developed in which up to about 30 weight percent of an insoluble material can be blended with a metal matrix which is at least partially liquid, that is, the metal is in a thixotropic state. Some of these methods are described in U.S. Pat. Nos. 3,948,650; 3,951,651; and 4,174,214. Such methods have several drawbacks in that they require careful temperature control, special equipment for melting, and agitation of the base metal.

The present invention overcomes some of the problems described above by providing an apparatus and method for forming a wear-resistant metal in which the insoluble solid additives are added to the base metal while the base metal is in a molten state.

SUMMARY OF THE INVENTION

The invention covers an apparatus and method for forming a wear-resistant metal composite, by adding a selected metal additive material to a base metal composition. In practice, the base metal composition is placed in a vessel suitable for containing the base metal in a molten state. The vessel includes a cover with an opening therein. A heating means is positioned exterior to the vessel. The vessel is heated to a temperature sufficient to melt the base metal composition and to keep this composition in a molten state. A pump having a suction side and a discharge side is mounted on the vessel with the pump head itself being suspended below the surface of the molten metal composition.

A feed tube is installed on the pump, with one end being connected into the suction side of the pump. The opposite end of the feed tube defines an open end suitable for receiving the metal additive material. There is at least one suction opening in the feed tube located between the ends of the tube. Within the vessel, the feed tube is positioned such that part of the suction opening lies above the surface of the molten metal composition and part of the opening lies below the metal surface. An inert atmosphere is provided above the surface of the molten metal.

In operation, the metal additive material is fed into the open end of the feed tube from a feeder means positioned above the vessel. The suction action of the pump causes a vortex at the surface of the molten metal composition and this action pulls the molten metal through the suction opening in the feed tube. The molten metal is thus mixed with the metal additive to form a molten metal mixture, which is discharged into the vessel through the discharge side of the pump. While the molten metal composition is in the vessel, it is continuously stirred to prevent the metal additive material from precipitating. Following the mixing step, the molten metal composition is removed from the vessel and poured into molds to let it solidify.

DESCRIPTION OF THE INVENTION

Figure 1:
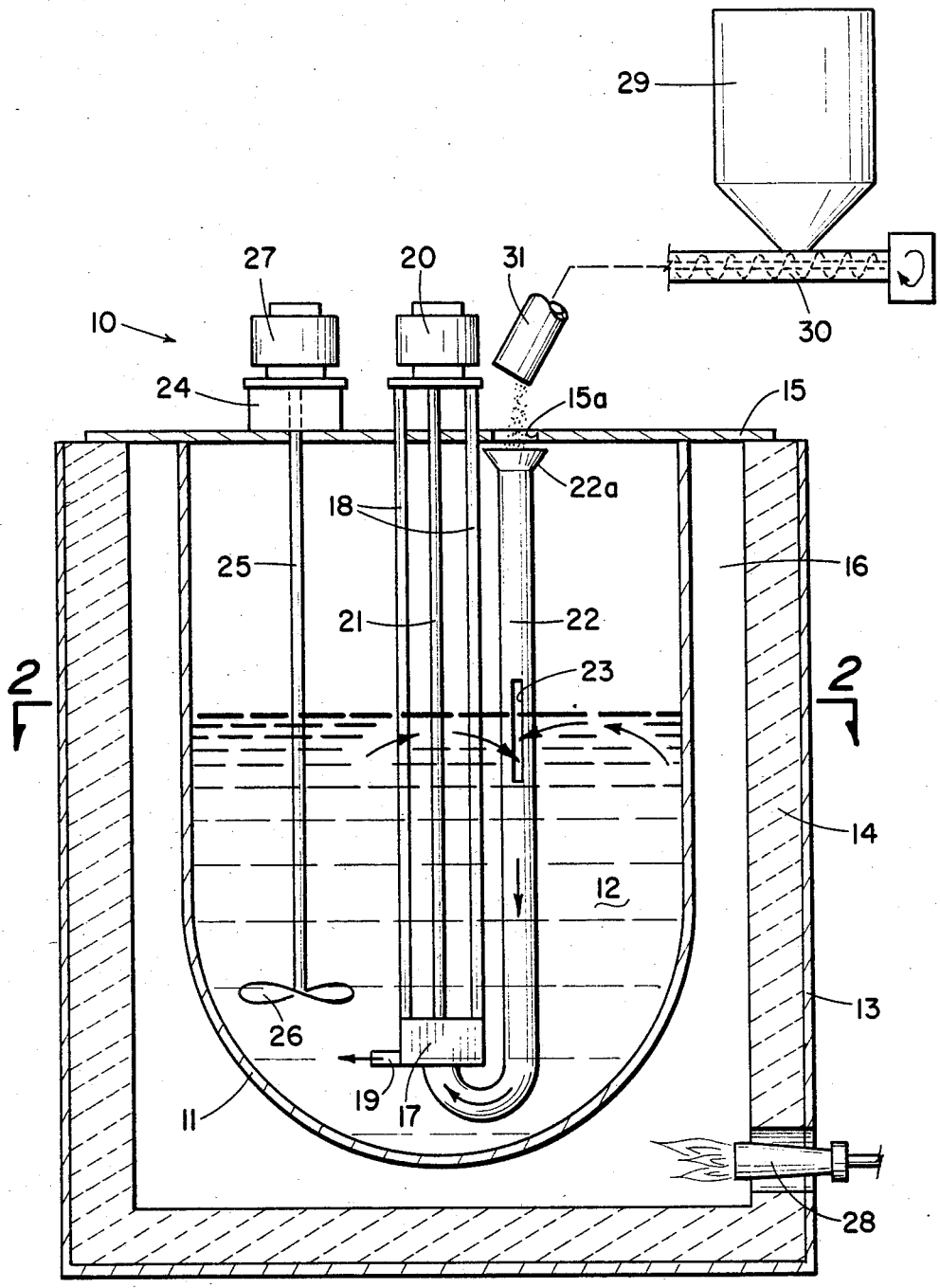
FIG. 1 is a front elevation view, mostly in section, of an apparatus useful for forming a wear-resistant metal composition, according to this invention.
Figure 2:
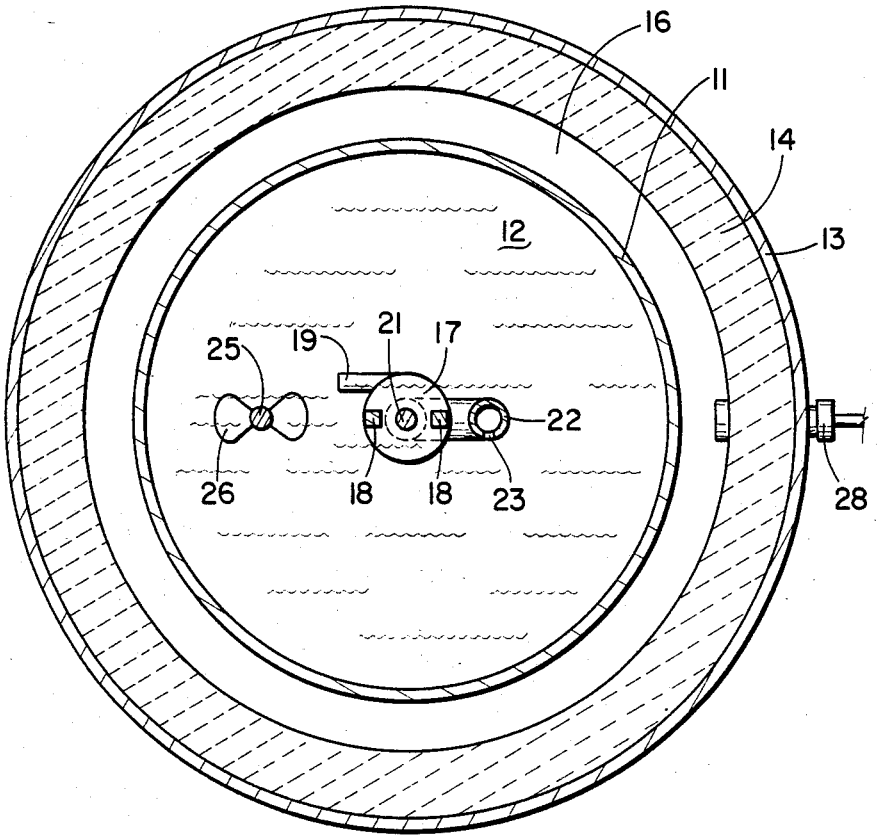
FIG. 2 is a view of the metal forming apparatus as taken on line 2—2 of FIG. 1.

Looking at FIG. 1, the metal forming apparatus is generally indicated by numeral 10. The apparatus includes a vessel 11, usually referred to as a crucible, which is designed for melting or heating solids at high temperatures. In the practice of this invention, the crucible 11 is designed for containing a molten metal or metal alloy 12, for example, a magnesium alloy. The apparatus includes a furnace shell 13, which is lined with a refractory material 14. A cover 15, having an opening 15*a* therein fits over the top of the crucible and the outer edge of the cover rests on the top edge of the refractory liner 14. This allows the crucible 11 to set down inside the furnace shell, with a space 16 being defined between the crucible and the shell liner.

A pump 17 is suspended in crucible 11 below the surface of the molten metal 12 by means of supports 18, which fasten into the crucible cover 15. In this operation it is preferred to use a centrifugal pump, which has a suction side (not referred to by a numeral) and a discharge side 19. The pump 17 is driven by an air motor 20 through a drive shaft 21. Another component of the pump is a feed tube 22. The lower end of the feed tube connects into the suction side of the pump. The upper end of the feed tube is defined by a funnel-shaped opening 22*a*, that makes it suitable for receiving a solid material.

Between the ends of feed tube 22 is a suction opening 23 in the tube, which has a rectangular shape. In the practice of this invention, the feed tube can include more than one suction opening, and the suction openings can be of different shapes, such as round, oval, square, or other shapes. The suction opening 23 should be located in the feed tube so that about half of the opening lies above the surface of the molten magnesium, and the other half lies below the molten metal surface.

Another component of this apparatus is a stirring device 24, which is mounted on the crucible cover 15. The stirring device includes a shaft 25 with a set of stir blades 26 mounted on its free end. As shown in FIG. 1, the shaft 25 extends down inside the crucible 11 far enough to place the stir blades well below the surface of the molten metal 12. The shaft and blades of the stirring device are driven by an air motor 27. One or more gas burners, indicated by numeral 28, are installed in the furnace shell 13, so that they heat the space 16 inside the shell that surrounds the crucible 11. The heat provided by the burners melts the metal 12 in the crucible and keeps it in a molten state.

OPERATION

The invention can be illustrated by describing a typical operation in which aluminum oxide ($Al_2O_3$) is added to a magnesium alloy, as the base metal, to produce a wear-resistant magnesium composition. In this operation, about 200 pounds of a conventional magnesium-based alloy (AZ91B) was weighed out and placed in the crucible 11. The base metal has a nominal composition of 9 weight percent aluminum, 0.7 weight percent zinc, 0.3 weight percent manganese, and 0.0005 weight percent beryllium, and the balance essentially magnesium. The burners 28 are started to heat the crucible and melt the magnesium composition at about 650° C. The pump 17 is submerged in the molten magnesium 12 and fastened in place on cover 15. The stirring device 24 is also fastened in place on the crucible cover, so that the blades 26 are submerged in the molten metal.

The pump is started and run at a speed high enough for the pump suction to generate a light vortex at the interface of the suction opening 23 and the surface of the molten magnesium. The speed will vary according to the particular design of the pump. The vortex must be large enough to create a positive "downflow" of the molten magnesium through the suction opening 23 into the feed tube 22. The downflow is necessary to break a magnesium oxide film which forms on the surface of the molten magnesium. In practice, it was found that the proper downflow can be obtained by positioning the suction opening 23 so that the surface of the molten magnesium is at about the midpoint of the opening.

In this operation it is desirable to hold the temperature of the molten magnesium alloy at about 630° C. to about 680° C. With regard to temperature, it is critical that the temperature of the metal 12 be at least 20° C. to 30° C. above that point at which the metal is in a thixotropic state (that is, partly solid and partly liquid). If the magnesium-based metal is not completely molten when the aluminum oxide composition is added, only a small amount of the aluminum oxide will mix with the base metal.

The next step is to mix the aluminum oxide with the molten magnesium base metal. The aluminum oxide, in the form of a powder, was stored in a holding tank 29. The holding tank is connected to a screw feeder 30 and delivery pipe 31. With the screw feeder in operation, the aluminum oxide powder, indicated by numeral 29, is pushed through the delivery pipe and dropped into feed tube 22 through the opening 15*a* in crucible cover. Before the aluminum oxide powder reaches the feed tube, it is pre-heated at about 200° C. to 300° C. to remove moisture. As the powder moves downwardly through the feed tube, it blends with the molten magnesium being pulled into the tube through the suction opening 23. The blend is pushed through the pump suction and the action of the impeller causes total "wetting" of the two metals. The resulting magnesium-aluminum oxide mixtures moves through the pump and is discharged into the body of molten metal in crucible 11.

During this operation, a protective gas atmosphere is maintained above the molten metal 12 to prevent the upper surface of the molten magnesium from burning. The composition of the gas atmosphere is about 0.3 percent $SF_6$, 50 percent $CO_2$ and the remainder about 50 percent air. The aluminum oxide powder is delivered into the feed tube at a rate of about 0 to 1.5 pounds per minute. Addition of the aluminum oxide is continued until about 6 pounds of the metal additive are mixed into the molten magnesium. The device 24 is used to stir the molten magnesium mixture continuously during the mixing operation. After all of the aluminum oxide is added, the pump is shut off and stirring is continued for several minutes.

Following the mixing operation, the metal composition is ladled into molds, where it is allowed to solidify. During the ladling step, small samples of the metal which are referred to as "button" samples, were retrieved for analysis. These samples were analyzed by conventional methods, such as the wet method and by use of electron microphotographs. The analysis showed that the aluminum oxide was substantially homogeneously dispersed in the magnesium matrix, and the aluminum oxide made up about 3.0 weight percent of the sample.

Other samples of a wear-resistant magnesium composition were prepared using the apparatus and method described above. One of these samples was a composite of magnesium allow (AZ91B) and aluminum oxide particles. Another sample was a composite of magnesium alloy (AZ91B) and spinel ($MgAl_2O_4$). The size of the aluminum oxide and spinel particles was in the range of from about 4 to 1,000 mesh (U.S. Standard Sieve Series). Analysis showed that in the magnesium-aluminum oxide composition the sample contained up to 30 percent $Al_2O_3$ particles by weight. In the magnesium-spinel composite the sample also contained up to 30 percent by weight of $MgAl_2O_4$ particles.

As described above, aluminum oxide or spinel are added to a magnesium alloy to improve its wear resistance. The practice of this invention also contemplates adding other metallic materials to magnesium, magnesium alloys, aluminum, or aluminum alloys to improve the wear resistance of these metals. The metallic additive materials include silicon carbide, lime powder, and boron carbide and they can be used in the practice of this invention in the form of powders, fibers or flakes.

The invention claimed is:

1. An apparatus for forming a wear-resistant magnesium or magnesium alloy, the apparatus includes:

a vessel for containing a molten magnesium or magnesium alloy metal composition, the vessel includes a cover having an opening therein;

means for heating the vessel to melt the magnesium composition and to keep the magnesium composition in a molten state, the heater means is positioned external to the vessel and the vessel includes an inert atmosphere above the surface of the molten magnesium composition;

a pump having a suction side and a discharge side, the pump is mounted on the vessel, and it is suspended in the vessel below the surface of the molten metal;

the pump includes a feed tube, one end of the feed tube connects into the suction side of the pump, the opposite end of the feed tube defines an open end suitable for receiving a metal additive, the open end is positioned below the vessel cover, the feed tube has at least one suction opening therein located between the ends of the tube, and the feed tube is positioned such that part of the suction opening lies above the surface of the molten magnesium composition and part of it lies below the magnesium surface;

means for stirring the molten magnesium composition, the stirring means is mounted on the vessel and it is suspended in the vessel below the surface of the molten magnesium;

means for feeding the solid material into the open end of the feed tube, the feeder means is positioned above the vessel;

wherein, the suction action of the pump creates a vortex at the surface of the molten magnesium composition, the vortex pulls the molten magnesium through the suction opening in the feed tube, which causes the molten magnesium to mix with the metal additive, and the mixture is discharged into the vessel through the discharge side of the pump.

2. The apparatus of claim 1 in which there are two suction openings in the feed tube, each opening has a rectangular shape, and each opening is positioned lengthwise in the feed tube.

3. The apparatus of claim 1 which further includes a shell member, the vessel sets inside the shell member, a space is defined between the vessel and shell member, and the means for heating the container is defined by at least one burner apparatus mounted on the shell member close to the vessel.

4. A method for forming a wear-resistant metal composition, by adding a selected metal additive material to a base metal composition, comprising the steps of:

placing the base metal composition in a vessel, the vessel has a cover with an opening therein;

heating the vessel to a temperature sufficient to melt the base metal composition and to keep the base metal composition in a molten state, the heating means is positioned external to the vessel;

mounting a pump on the vessel, the pump has a suction side and a discharge side, and the pump is suspended in the vessel below the surface of the molten metal composition;

installing a feed tube on the pump, one end of the feed tube connects into the suction side of the pump, the opposite end of the feed tube defines an open end suitable for receiving the metal additive material, the feed tube has at least one suction opening therein located between the ends of the tube, and the feed tube is positioned such that part of the suction opening lies above the surface of the molten metal composition and part of it lies below said metal surface;

providing an inert atmosphere in the vessel above the surface of the molten metal;

feeding the metal additive material into the open end of the feed tube from a feeder means positioned above the vessel;

causing a vortex at the surface of the molten metal composition, by the suction action of the pump, to pull the molten metal composition through the suction opening in the feed tube;

mixing the molten metal composition with the metal additive in the feed tube, to form a molten metal mixture;

discharging the molten metal mixture into the vessel through the discharge side of the pump; and continuously stirring the molten metal composition.

5. The method of claim 4 which further includes the steps of removing the molten metal mixture from the vessel, and solidifying the mixture.

6. The method of claim 4 in which the base metal composition is a member of the group consisting of magnesium, aluminum, or alloys thereof.

7. The method of claim 4 in which the metal additive material is a member of the group consisting of aluminum oxide, boron carbide, silicon carbide, or spinel.

8. The method of claim 7 in which each metal additive material is in the form of powders, fibers, or flakes.

9. A method for forming a wear-resistant magnesium or magnesium alloy, which comprises the steps of:

placing a magnesium or magnesium alloy metal composition in a vessel, the vessel has a cover with an opening therein;

heating the container to a temperature of from about 630° C. to 680° C. to melt the magnesium composition and to hold the magnesium composition in a molten state, the heating means is positioned external to the vessel, mounting a pump on the vessel, the pump has a suction side and a discharge side, and the pump is suspended in the vessel below the surface of the molten magnesium composition;

installing a feed tube on the pump, one end of the feed tube connects into the suction side of the pump, the opposite end of the feed tube defines an open end suitable for receiving a metal additive material, the open end is positioned below the vessel cover, the feed tube has at least one suction opening therein located between the ends of the tube, and the feed tube is positioned such that part of the suction opening lies above the surface of the molten magnesium composition and part of it lies below the magnesium surface;

providing an inert atmosphere in the vessel above the surface of the molten magnesium composition;

feeding an aluminum oxide powder into the open end of the feed tube from a feeder means positioned above the vessel, the amount of aluminum oxide powder is from about 3 weight percent to about 30 weight percent of the magnesium composition;

causing a vortex at the surface of the molten magnesium composition, by the suction action of the pump, to pull the molten magnesium through the suction opening in the feed tube;

mixing the molten magnesium composition with the aluminum oxide powder in the feed tube, to form a molten metal composition which contains magnesium and aluminum oxide;

discharging the molten metal composition into the vessel through the discharge side of the pump;

continuously stirring the molten metal composition; and removing the molten metal composition from the vessel and solidifying the metal composition.

10. The method of claim 9 which includes the step of heating the aluminum oxide composition to a temperature of from about 200° C. to about 300° C. before the oxide composition is passed into the feed tube from the feeder means.

* * * * *